US005638544A

United States Patent [19]

Sump

[11] Patent Number: 5,638,544

[45] Date of Patent: Jun. 17, 1997

[54] MILITARY HELMET WITH CAMOUFLAGE BAND RETAINING SYSTEM AND METHOD FOR RETAINING A CAMOUFLAGE BAND ON A MILITARY HELMET

[75] Inventor: Mallory L. Sump, Mauk, Ga.

[73] Assignee: Ranger Joe's Columbus Army Surplus Co., Columbus, Ga.

[21] Appl. No.: 653,726

[22] Filed: May 23, 1996

[51] Int. Cl.[6] ..... A42B 3/00

[52] U.S. Cl. ..... 2/6.6; 2/422; 2/900

[58] Field of Search ..... 2/6.6, 410, 416, 2/422, 205, 209.13, 175.6, 184.5, 200.1, DIG. 11, 900

[56] References Cited

U.S. PATENT DOCUMENTS

| | | | |
|---|---|---|---|
| 2,911,652 | 11/1959 | Ekman | 2/175.6 |
| 3,015,104 | 1/1962 | Crosson et al. | 2/900 |
| 4,106,124 | 8/1978 | Green | 2/422 |
| 4,575,871 | 3/1986 | Auerbach et al. | 2/6.6 |
| 5,471,678 | 12/1995 | Dor | 2/422 |

FOREIGN PATENT DOCUMENTS

| | | | |
|---|---|---|---|
| 682324 | 10/1939 | Germany | 2/6.6 |
| 548528 | 10/1942 | United Kingdom | 2/6.6 |

*Primary Examiner*—Michael A. Neas
*Attorney, Agent, or Firm*—Jones & Askew

[57] ABSTRACT

A helmet including a camouflage band retaining system for retaining an elastic camouflage band about the upper portion of a helmet dome. The elastic camouflage band is useful for holding camouflage elements against the outer surface of the dome. The camouflage band retaining system includes a plurality of straps attached to and spaced about the helmet and engaged with the elastic camouflage band so as to prevent the elastic camouflage band from sliding away from the rim, over the upper portion of the helmet and off of the helmet. A method for retaining an elastic camouflage band about a helmet is also disclosed and includes the steps of attaching a plurality of straps to the helmet so that the straps are spaced about the helmet and engaging the straps with the elastic camouflage band so as to prevent the elastic camouflage band from sliding away from the rim, over the upper portion of the helmet, and off of the helmet.

24 Claims, 4 Drawing Sheets

MILITARY HELMET WITH CAMOUFLAGE BAND RETAINING SYSTEM AND METHOD FOR RETAINING A CAMOUFLAGE BAND ON A MILITARY HELMET

TECHNICAL FIELD

This invention generally relates to military helmets, and more particularly relates to camouflage systems for military helmets.

BACKGROUND OF THE INVENTION

Military helmets are often worn with camouflage elements, such as real or artificial foliage, attached to the helmet. The standard United States military helmet currently in use is made of KEVLAR aramid fiber material and includes a dome having an outer surface, an inner surface, and a rim, which, along with the inner surface, defines a cavity for receiving the wearer's head. Such a helmet has an upper portion and an expanded lower portion extending from the upper portion to the rim. These military helmets are often covered with a fabric camouflage cover having slits therein for receiving the camouflage elements and have an elastic camouflage band fitted about the upper portion of the helmet dome adjacent the expanded portion of the dome to anchor the camouflage elements to the helmet. However, because the camouflage band is elastic and the upper portion of the helmet slopes upwardly, the elastic camouflage band sometimes slips up and over the upper portion and off of the helmet. Accordingly, there is a need for a military helmet with a more secure and reliable camouflage system.

SUMMARY OF THE INVENTION

The present invention solves the above described problem by providing a helmet with a camouflage band retaining system. Generally described, the camouflage band retaining system of the present invention comprises a plurality of straps attached to and spaced about the helmet and engaged with the camouflage band so as to prevent the elastic camouflage band from sliding away from the rim of the helmet, over the upper portion of the helmet, and off of the helmet. With the camouflage band retaining system of the present invention, camouflage elements are more secure on the helmet and the elastic camouflage band is less likely to be lost.

More particularly, the helmet of the present invention comprises a dome having an outer surface, an inner surface, a rim, which, along with the inner surface, defines a cavity for receiving a wearer's head, an upper portion, and an expanded portion extending from the upper portion of the helmet to the rim. The helmet also includes an elastic camouflage band fitted about the upper portion of the dome for holding camouflage elements against the outer surface of the dome. Desirably, the straps of the camouflage band retaining system are attached to the inner surface of the dome and extend from the inner surface, over the rim and the expanded portion of the dome, to the elastic camouflage band.

Still more particularly, each strap of the camouflage band retaining system comprises a selectively releasable fastener comprising a male component and a female component spaced from one another along the strap so that the elastic camouflage band can be selectively retained on the helmet by looping each strap around the elastic camouflage band and engaging the male and female components of the respective releasable fasteners. Alternatively, the elastic camouflage band can be released from the helmet by disengaging the male and female components of the respective releasable fasteners. A particularly suitable releasable fastener is a hook and loop fastener such as a VELCRO fastener.

In a preferred embodiment, the helmet has a forward portion, a rearward portion, and opposing sides extending between the forward portion and the rearward portion. The plurality of straps include a pair of forward straps and a rearward strap. The pair of forward straps each comprise a single releasable fastener and are positioned on respective opposing sides of the dome proximate the forward portion of the dome. The rearward strap comprises two selectively releasable fasteners spaced from one another and a portion of the rearward strap between the two releasable fasteners of the rearward strap is attached to the rearward portion of the dome so that the rearward strap extends outwardly toward both of the opposing sides of the dome and engages the elastic camouflage band at two locations spaced from one another.

The present invention also encompasses a method for retaining an elastic camouflage band on a helmet. Generally described, the method comprises the steps of attaching a plurality of straps to a helmet so that the straps are spaced about the helmet and engaging the straps with the elastic camouflage band so as to prevent the elastic camouflage band from sliding away from the rim, over the upper portion of the helmet, and off of the helmet.

Accordingly, an object of the present invention is to provide a method for improving the camouflage system of a helmet and the resulting helmet with an improved camouflage system.

Another object of the present invention is to provide a helmet with a more secure and reliable camouflage system.

Still another object of the present invention is to provide a helmet with an elastic camouflage band which will not accidentally slip off of the helmet or slip out of position on the helmet.

Other objects, features, and advantages of the present invention will become apparent from the following detailed description, claims and drawings.

DETAILED DESCRIPTION OF DRAWINGS

As summarized above, this invention encompasses a helmet, particularly a military helmet, with a camouflage band retaining system and a method for retaining a camouflage band on a military helmet. The camouflage band retaining system disclosed herein is particularly suitable for the current standard issue United States military helmet made with KEVLAR fibrous aramid material. FIGS. 1–6 illustrate such a standard issue military helmet with a camouflage band retaining system made according to a preferred embodiment of this invention.

Figure 1:
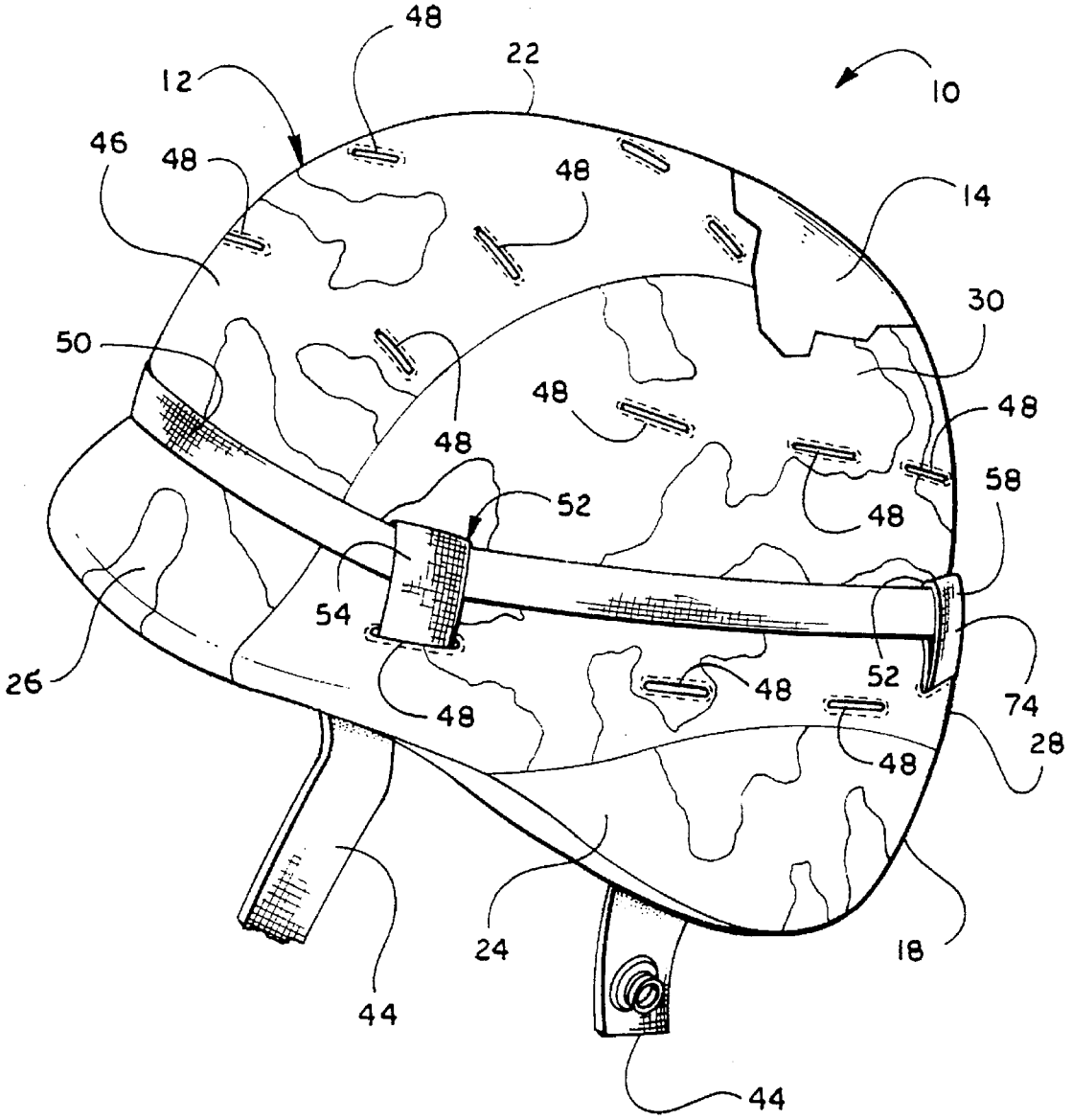
FIG. 1 is a perspective of a military helmet with an elastic camouflage band retaining system made in accordance with an embodiment of the present invention.
Figure 2:
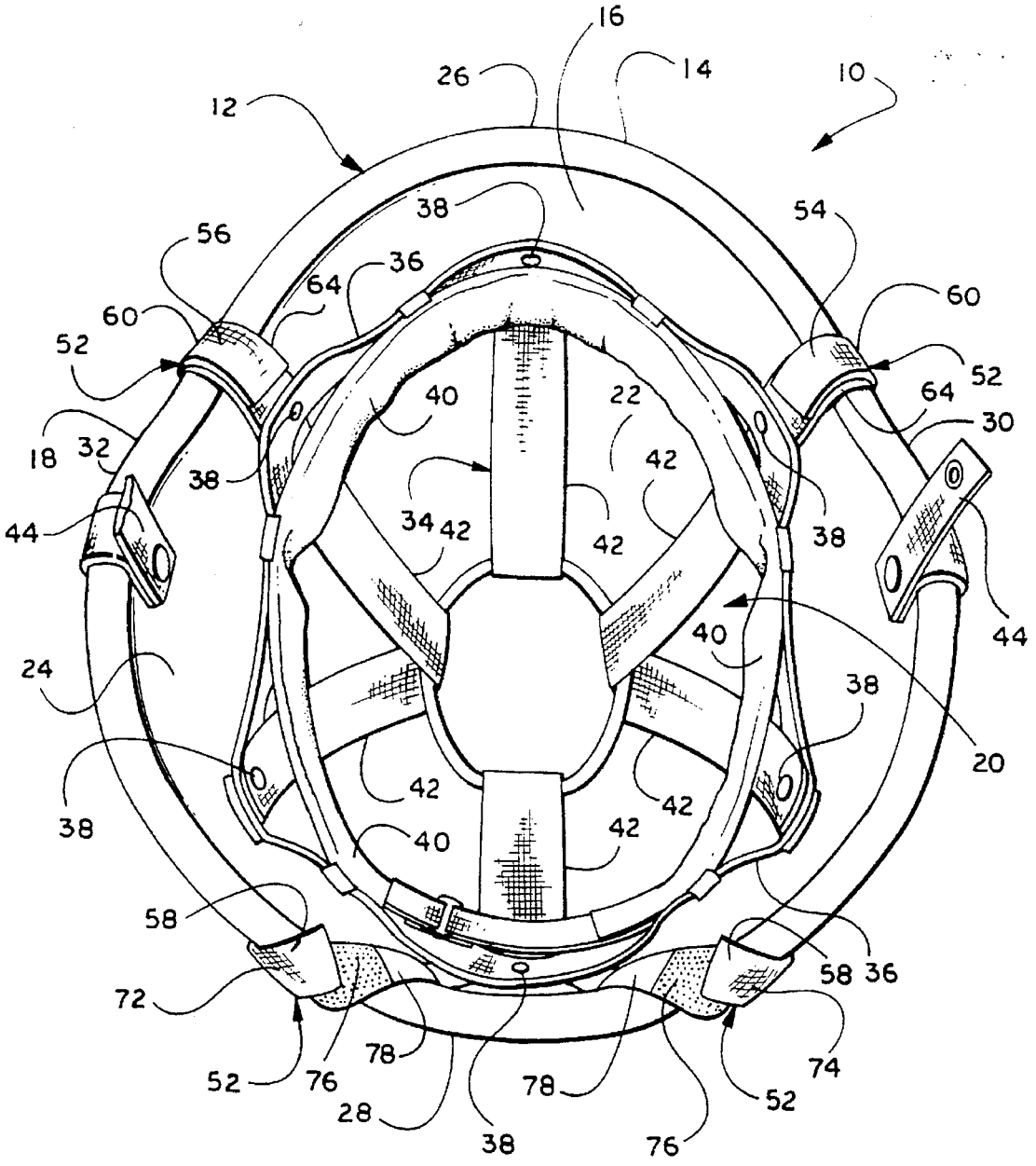
FIG. 2 is a plan view of the helmet shown in FIG. 1 illustrating the inner cavity of the helmet without the camouflage cover.
Figure 4:
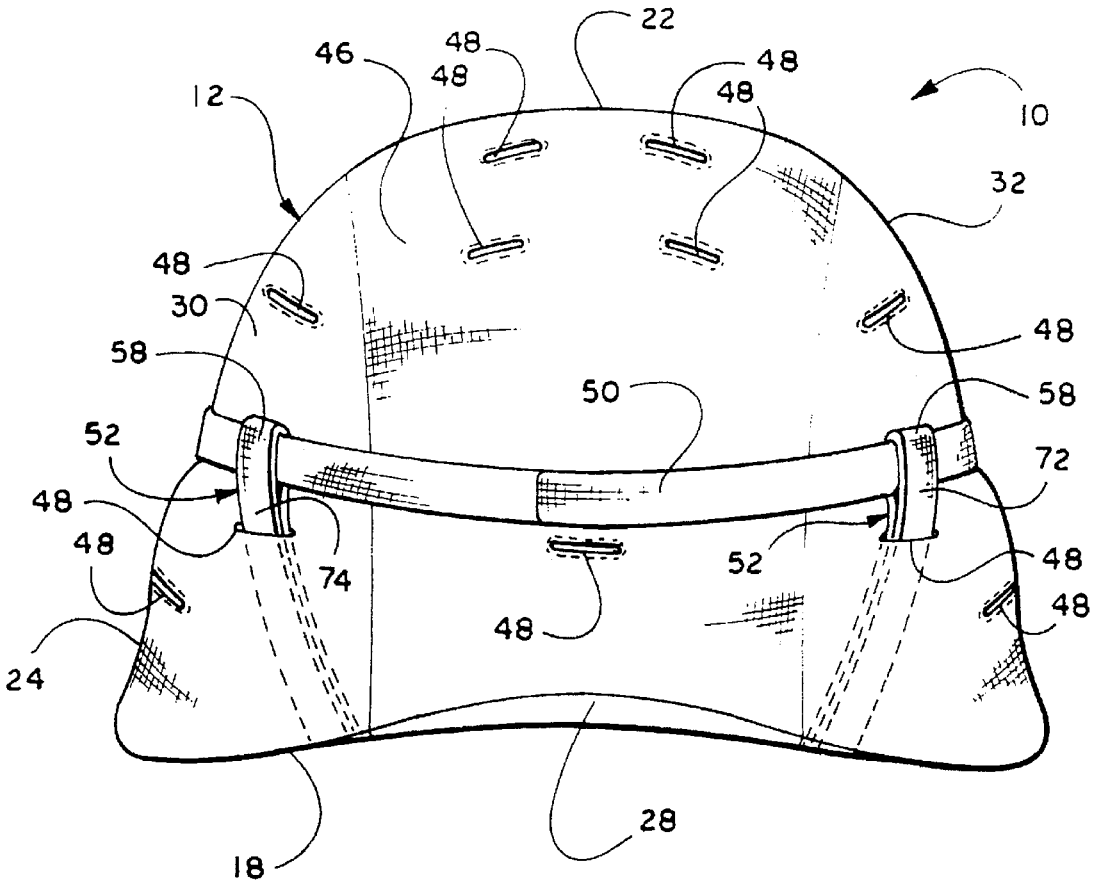
FIG. 4 is a rearward elevation view of the helmet shown in FIG. 1 illustrating the rearward straps of the elastic camouflage band retaining system.

Turning to FIGS. 1 and 2, a military helmet 10 is illustrated and generally comprises a dome 12 having an outer surface 14 and an inner surface 16. A rim 18, along with the inner surface 16 of the dome 12, defines a cavity 20 for receiving a wearer's head. The dome 12 includes an upper portion 22 which fits over the top of a wearer's head and an expanded portion 24 extending from the upper portion of the dome to the rim 18 for covering the sides, forehead, and back of the wearer's head. The helmet 10 has a forward portion 26 for covering the wearer's forehead, a rearward portion 28 for covering the back of the wearer's head, and opposing sides 30 and 32 extending between the forward portion and the rearward portion to protect the sides of the wearer's head.

FIG. 2 illustrates a helmet suspension system 34 which is standard equipment for military helmets and is not described here in detail. The helmet suspension system 34 rests about the wearer's head and spaces the helmet 10 from the wearer's head while providing for a more secure and comfortable fit. The helmet suspension system 34 generally includes an outer band 36 secured to the inner surface 16 of the helmet 10 with bolts 38 spaced about the cavity 20, an inner band 40 which fits directly about the wearer's head, and a plurality of overhead straps 42 extending from the outer band.

The helmet 10 also includes a conventional chin strap 44 which is only partially illustrated in the drawings and is not described in detail, and a camouflage cover 46 (shown in FIGS. 1, 3, and 4, but not FIG. 2), which is typically made of cloth, fitted tightly about the outer surface 14 of the helmet, and tucked snugly about the rim 18 of the helmet. The camouflage cover 46 is anchored to the helmet 10 with releasable straps (not shown) which tie the camouflage cover to the outer band 36 of the helmet suspension system 34. The camouflage cover 46 includes a plurality of slits 48 in which camouflage elements( not shown), such as real or artificial foliage, can be tucked. An elastic camouflage band 50 fits snugly about the upper portion 22 of the helmet dome 12 adjacent the expanded portion 24 of the dome for holding the camouflage elements in place on the helmet. The elastic camouflage band 50 can be used to hold camouflage elements tucked into the slits 48 in the camouflage cover 46 or tucked directly beneath the elastic camouflage band.

To prevent the elastic camouflage band 50 from slipping up and over the upper portion 22 of the helmet dome 12, a camouflage band retaining system 52 is mounted to the helmet 10. As will be understood by those skilled in the art, any number of straps may be used to form the retaining system 52, however, for current standard issue United States military helmets made of KEVLAR, like the helmet illustrated in FIGS. 1–4, the camouflage band retaining system desirably includes three straps, a pair of forward straps 54 and 56 and a rearward strap 58. These straps 54, 56, and 58 are spaced about the helmet dome 12 and anchor the elastic camouflage band 50 to the helmet dome as illustrated in FIGS. 1–4 and described below.

Figure 5:
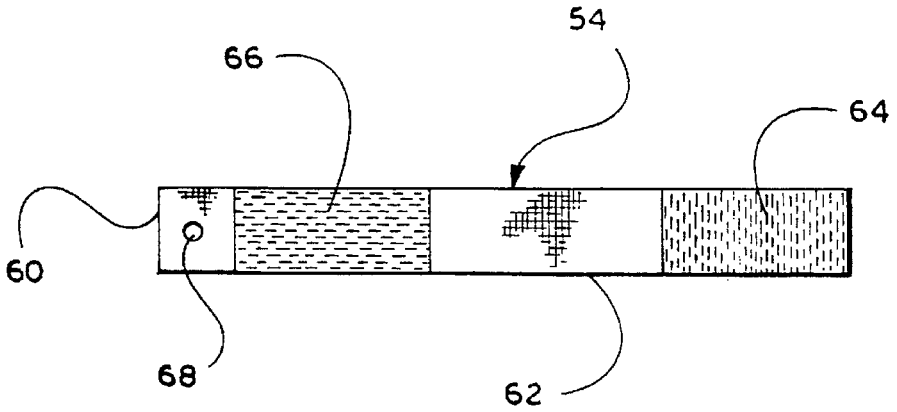
FIG. 5 is a plan view of a frontal strap which forms part of the elastic camouflage band retaining system illustrated in FIGS. 1–4.

The forward straps 54 and 56 are identical and one is illustrated in FIG. 5. The forward strap 54 illustrated in FIG. 5 comprises a mounting portion 60 at one end and a looping portion 62 extending from the mounting portion to a distal end. The forward strap 54 includes a selectively releasable hook and loop fastener, such as a VELCRO fastener, which includes a hook component 64 and a loop component 66. The hook component 64 is the male component of the releasable fastener and comprises a plurality of plastic hooks which mate with the loop component 66. The loop component 66 is the female component of the releasable fastener and includes loops of tufted fibers. The hook component 64 and the loop component 66 are attached to the same one side of the forward strap 54 and are spaced from one another so that when the hook and loop components are engaged, the forward strap forms a loop extending from the mounting portion 60. The hook component 64 is shown in FIG. 5 as positioned adjacent the mounting portion 60 and the loop component 66 is shown as being mounted spaced from the hook component and the mounting portion such that the hook component is between the loop component and the mounting portion. However, it should be understood that the positions of the hook component 64 and the loop component 66 are interchangeable and it should also be understood that other types of selectively releasable fasteners such as snaps or buttons may be used, but hook and loop fasteners are preferred because of their ease in use. The forward strap 54 is mountable to the inner surface 16 of the helmet dome 12 with a bolt, such as one of the bolts 38 used to mount the helmet suspension system 34 to the helmet dome. The bolts 38 can fit through a hole 68 in the mounting portion 60 of the forward strap 54.

The rearward strap 58 also includes a mounting portion 70 for attachment to the inner surface 16 of the helmet dome 12, but includes two loop portions 72 and 74 extending from each end of the mounting portion such that the mounting portion is between the two looping portions. Each of the looping portions 72 and 74 include a selectively releasable fastener which is desirably a hook and loop fastener as illustrated with regard to the forward strap 54. As can be seen from FIG. 6, the rearward strap 58 includes two hook and loop fasteners both of which are mounted on the same one side of the rearward strap and each include a hook component 76 and a loop component 78 and operate in the same manner as the hook and loop components of the forward strap 54. A hole 80 in the mounting portion 70 of the rearward strap 58 is used for securing the rearward strap to the inner surface 16 of the helmet dome 12 with one of the bolts 38.

Desirably, each of the forward and rearward straps 54, 56, and 58 are constructed of fabric such as nylon webbing. Particular dimensions for forward and rearward straps 54, 56, and 58 for use with a current standard issue United States military helmet made with KEVLAR are as follows.

The forward straps 54 and 56 each have an overall length of eight inches and a width of three-quarters of an inch. The mounting portion 60 has a length of one inch and the looping portion 62 has a length of seven inches. Both the hook component 64 and the loop component 66 have a length of two inches while the hole 68 for receiving one of the bolts 38 has a diameter of one-quarter inch. The hook and loop components 64 and 66 are spaced three inches apart.

The rearward strap 58 has a total length of twenty-four inches and a width of three-quarters of an inch. The mounting portion 70 of the rearward strap 58 is located in the center of the rearward strap and has a length of four inches with the hole 80 is in the center of the mounting portion and has a diameter of one-quarter inch. Each of the looping portions 72 and 74 have a length of ten inches. The hook component 76 of each releasable fastener has a length of two inches and the loop component 78 of each releasable fastener has the length of three inches. The hook component and loop component 76 and 78 of each releasable fastener are spaced five inches apart from one another. The hook and loop components of both the forward straps 54 and 56 and the rearward strap 58 each have a width of three-quarters of an inch.

Figure 3:
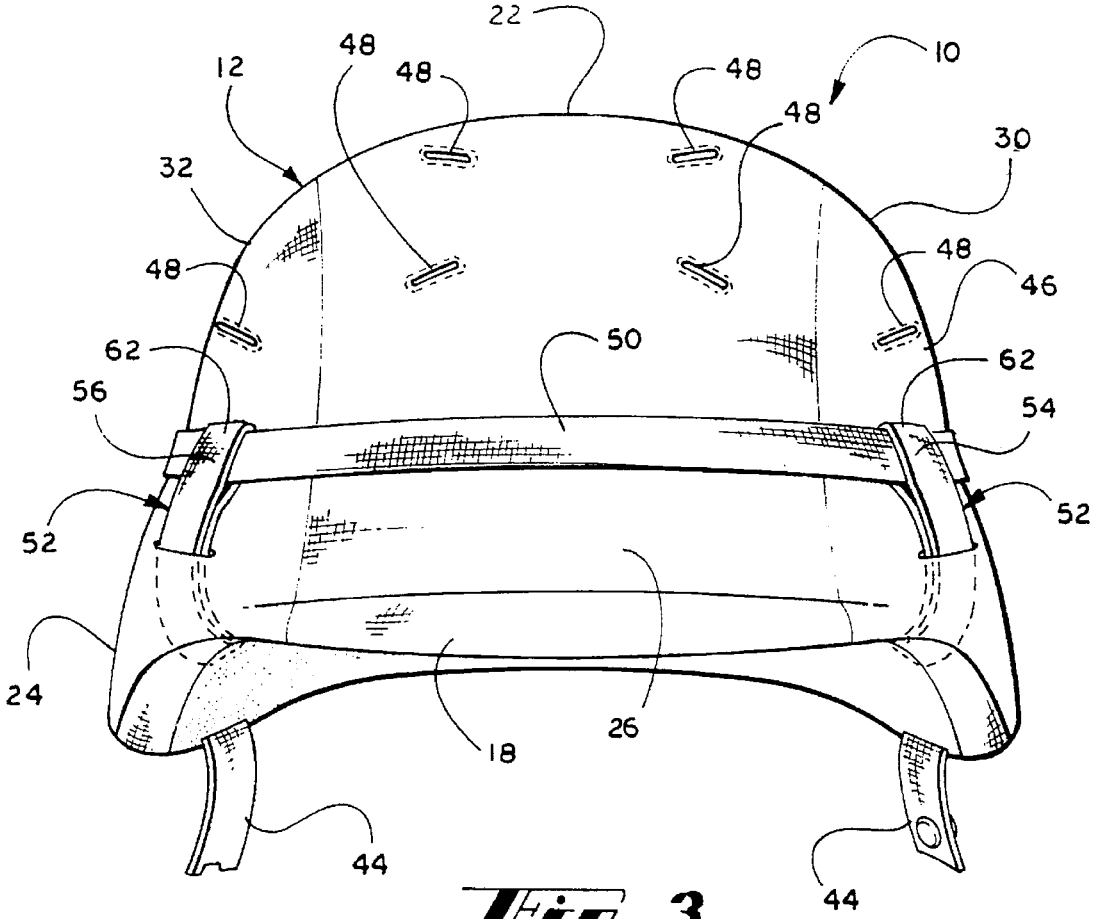
FIG. 3 is a frontal elevation view of the helmet shown in FIG. 1 illustrating the forward straps of the elastic camouflage band retaining system.
Figure 6:
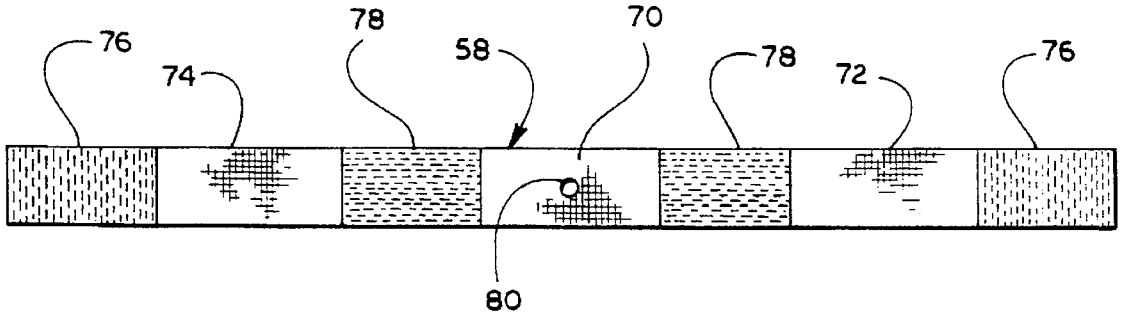
FIG. 6 is a rearward strap which forms part of the elastic camouflage band retaining system illustrated in FIGS. 1–4.

As best illustrated in FIGS. 2 and 3, the forward straps 54 and 56 are attached to the inner surface 16 of the helmet dome 12 on respective opposing sides 30 and 32 proximate the forward portion 26 of the dome. The mounting portion 60 of each forward strap 54 and 56 is attached to the inner surface 16 of the dome 12 with the same bolts 38 used to attach the helmet suspension system 34 to the dome at the same locations. The looping portion 62 of each forward strap 54 and 56 is then extended from the inner surface 16 of the dome 12, beneath the camouflage cover 46, over the rim 18 of the dome, up the expanded portion 24 of the dome, out of the camouflage cover through respective slits 48 in the camouflage cover, around the elastic camouflage band 50, and then back through the respective slits in the camouflage cover. The hook and loop component 64 and 66 of the forward straps 54 and 56 are then engaged to form loops about the elastic camouflage band 50 with the forward straps and anchor the elastic camouflage band to the upper portion 22 of the helmet dome 12 proximate the forward portion 26 of the dome. The forward straps 54 and 56 can be easily released by disengaging the hook and loop components 64 and 66 of the forward straps.

The rearward strap 58 is attached to the inner surface 16 of the helmet dome 12 at the rearward portion 28 of the dome. The mounting portion 70 of the rearward strap 58 is attached to the inner surface 16 of the dome 12 with one of bolts 38 used to attach the helmet suspension system 34 to the dome at the rearward portion 28 of the dome. The looping portions 72 and 74 of the rearward strap 58 extend from the mounting portion 70 of the rearward strap in opposite directions over the inner surface 16 of the dome, beneath the camouflage cover 46, over the rim 18, and outwardly over the expanded portion 24 of the dome, out of the camouflage cover through respective slits 48 in the camouflage cover, around the elastic camouflage band 50 at locations spaced from one another, and back the through respective slits in the camouflage cover to form loops around the elastic camouflage band. The hook and loop components 76 and 78 of the respective looping portions 72 and 74 of the rearward strap 58 are engaged to form closed loops about the elastic camouflage band 50 and anchor the elastic camouflage band to the upper portion 22 of the helmet dome 12 at the rearward portion 28 of the dome. The releasable fasteners of the reward strap 58 can be easily released by disengaging the hook and loop components 76 and 78 of the releasable fasteners.

It should be understood that the foregoing relates to particular embodiments of the present invention and that numerous changes can be made therein without departing from the scope of the invention as defined by the following claims.

I claim:

1. A helmet comprising:

a dome having an outer surface, an inner surface, a rim, which, along with the inner surface, defines a cavity for receiving a wearer's head, an upper portion, and an expanded portion extending from the upper portion to the rim;

an elastic camouflage band fitted about the upper portion of the dome for holding camouflage elements against the outer surface of the dome; and a camouflage band retaining system comprising a plurality of straps attached to and spaced about the helmet and engaged with the elastic camouflage band so as to prevent the elastic camouflage band from sliding away from the rim, over the upper portion of the helmet, and off of the helmet.

2. A helmet as in claim 1 wherein the straps are attached to the inner surface of the dome and extend from the inner surface over the rim and the expanded portion to the elastic camouflage band.

3. A helmet as in claim 2 wherein each strap comprises a selectively releasable fastener comprising a male component and a female component spaced from one another along the strap so that the elastic camouflage band can be selectively retained on the helmet by looping each strap around the elastic camouflage band and engaging the male and female components of the respective releasable fasteners, and alternatively, released from the helmet by disengaging the male and female components of the respective releasable fasteners.

4. A helmet as in claim 3 wherein the releasable fasteners are hook and loop fasteners.

5. A helmet as in claim 3 wherein the dome has a forward portion, a rearward portion, and opposing sides extending between the forward portion and the rearward portion, the plurality of straps including a pair of forward straps and a rearward strap, the pair of forward straps each comprising a single releasable fastener and positioned on respective opposing sides proximate the forward portion of the dome, the rearward strap comprising two selectively releasable fasteners spaced from one another and a portion of the rearward strap between the two releasable fasteners of the rearward strap being attached to the rearward portion of the dome so the rearward strap extends outwardly toward both of the opposing sides of the dome and engages the elastic camouflage band at two locations spaced from one another.

6. A helmet as in claim 2 further comprising a helmet suspension system disposed inside the cavity of the dome and attached to the inner surface of the dome with a plurality of bolts, the straps attached to the inner surface of the dome with the same bolts used to attach the helmet suspension system to the inner surface of the dome.

7. A helmet as in claim 2 further comprising a camouflage cover covering the outer surface of the dome and having a plurality of slits therein, the elastic camouflage band fitted over the camouflage cover and the straps extending from the inner surface of the dome, under the camouflage cover, over the rim, and out of the camouflage cover through respective slits in the camouflage cover to engage the elastic camouflage band.

8. A helmet as in claim 3 wherein each strap has a mounting portion and a looping portion, the male and female components of each releasable fastener are attached to one side of the respective strap along the looping portion of the respective strap, the mounting portions of each strap are attached to the inner surface of the dome, and the looping portion of each strap extends around the elastic camouflage band and forms a closed loop when the straps are engaged with the elastic camouflage band and the releasable fasteners are engaged.

9. A helmet comprising:

a dome having an outer surface, an inner surface, a rim, which, along with the inner surface, defines a cavity for receiving a wearer's head, an upper portion, an expanded portion extending from the upper portion to the rim, a forward portion, a rearward portion, and opposing sides extending between the forward portion and the rearward portion;

an elastic camouflage band fitted about the upper portion of the dome for holding camouflage elements against the outer surface of the dome; and a camouflage band retaining system comprising:

a pair of forward straps each having a mounting portion and a looping portion, the mounting portion of each forward strap attached to the inner surface of the dome on respective opposing sides proximate the forward portion of the dome, each of the forward straps comprising a single releasable fastener including a male component and a female component spaced from one another along the looping portion of the respective forward strap and attached to one side of the respective forward strap; and a rearward strap having two looping portions and a mounting portion between the two looping portions, the mounting portion of the rearward strap attached to the inner surface of the dome at the rearward portion of the dome, the rearward strap comprising two selectively releasable fasteners both attached to one side of the rearward strap, one of the selectively releasable fasteners attached to one of the looping portions of the rearward strap and another of the selectively releasable fasteners attached to another of the looping portions of the rearward strap, each of the selectively releasable fasteners of the rearward strap including a male and a female component spaced from one another along respective looping portions of the rearward strap, so that the elastic camouflage band can be selectively retained on the helmet by extending the looping portions of the forward and rearward straps over the rim and the expanded portion of the dome, looping the looping portions of the straps around the elastic camouflage band, and engaging the male and female components of the respective releasable fasteners to form closed loops with the looping portions, and alternatively, released from the helmet by disengaging the male and female components of the respective releasable fasteners.

10. A helmet as in claim 9 wherein the releasable fasteners are hook and loop fasteners.

11. A helmet as in claim 9 further comprising a helmet suspension system disposed inside the cavity of the dome and attached to the inner surface of the dome with a plurality of bolts, the forward straps and rearward strap attached to the inner surface of the dome with the same bolts used to attach the helmet suspension system to the inner surface of the dome.

12. A helmet as in claim 9 further comprising a camouflage cover coveting the outer surface of the dome and having a plurality of slits therein, the elastic camouflage band fitted over the camouflage cover and the forward straps and rearward strap extending from the inner surface of the dome, under the camouflage cover, over the rim and out of the camouflage cover through respective slits in the camouflage cover to engage the elastic camouflage band.

13. A method for retaining an elastic camouflage band on a helmet, the helmet comprising a dome having an outer surface, an inner surface, a rim, which, along with the inner surface, defines a cavity for receiving a wearer's head, an upper portion, and an expanded portion extending from the upper portion to the rim, the elastic camouflage band fitted about the upper portion of the dome for holding camouflage elements against the outer surface of the dome, the method comprising the steps of:

attaching a plurality of straps to the helmet so that the straps are spaced about the helmet; and engaging the straps with the elastic camouflage band so as to prevent the elastic camouflage band from sliding away from the rim, over the upper portion of the helmet, and off of the helmet.

14. A method as in claim 13 wherein the step of attaching the straps to the helmet comprises attaching the straps to the inner surface of the dome and the step of engaging the straps comprises extending the straps from the inner surface, over the rim and the expanded portion, to the elastic camouflage band.

15. A method as in claim 14 wherein each strap comprises a selectively releasable fastener comprising a male component and a female component spaced from one another along the strap and the step of engaging the elastic camouflage band includes looping each strap around the elastic camouflage band and engaging the male and female components of the respective releasable fasteners.

16. A method as in claim 15 wherein the releasable fasteners are hook and loop fasteners.

17. A method as in claim 15 wherein the dome has a forward portion, a rearward portion, and opposing sides extending between the forward portion and the rearward portion, the plurality of straps include a pair of forward straps and a rearward strap, the pair of forward straps each comprise a single releasable fastener, the rearward strap comprises two selectively releasable fasteners spaced from one another, the step of attaching the straps to the helmet includes attaching the forward straps to respective opposing sides of the dome proximate the forward portion of the dome and attaching a portion of the rearward strap between the two releasable fasteners of the rearward strap to the rearward portion of the dome, and the step of engaging the elastic camouflage band includes extending the rearward strap outwardly toward both of the opposing sides of the dome and engaging the elastic camouflage band at two locations spaced from one another.

18. A method as in claim 14 wherein the helmet further comprises a helmet suspension system disposed inside the cavity of the dome and attached to the inner surface of the dome with a plurality of bolts, and the step of attaching the straps to the dome includes attaching the straps to the inner surface of the dome with the same bolts used to attach the helmet suspension system to the inner surface of the dome.

19. A method as in claim 14 wherein the helmet further comprises a camouflage cover covering the outer surface of the dome and having a plurality of slits therein, the elastic camouflage band being fitted over the camouflage cover and the step of engaging the elastic camouflage band includes extending the straps from the inner surface of the dome, over the rim, under the camouflage cover, and out of the camouflage cover through respective slits in the camouflage cover.

20. A method as in claim 15 wherein each strap has a mounting portion and a looping portion, the male and female components of each releasable fastener are attached to one side of the respective strap along the looping portion of the respective strap, the step of attaching the straps to the dome includes attaching the mounting portions of each strap to the inner surface of the dome, and the step of engaging the elastic camouflage band includes extending the looping portion of each strap around the elastic camouflage band and engaging the releasable fasteners to form a closed loop about the elastic camouflage band.

21. A method for retaining an elastic camouflage band on a helmet, the helmet comprising a dome and an elastic camouflage band, the dome having an outer surface, an inner surface, a rim, which, along with the inner surface, defines a cavity for receiving a wearer's head, an upper portion, an expanded portion extending from the upper portion to the rim, a forward portion, a rearward portion, and opposing sides extending between the forward portion and the rearward portion, the elastic camouflage band fitted about the upper portion of the dome for holding camouflage elements against the outer surface of the dome, the method comprising the steps of:

providing a pair of forward straps each having a mounting portion and a looping portion, each of the forward straps comprising a single releasable fastener including a male component and a female component spaced from one another along the looping portion of the respective forward strap and attached to one side of the respective forward strap;

providing a rearward strap having two looping portions and a mounting portion between the two looping portions, the rearward strap comprising two selectively releasable fasteners both attached to one side of the rearward strap, one of the selectively releasable fasteners attached to one of the looping portions of the rearward strap and another of the selectively releasable fasteners attached to another of the looping portions of the rearward strap, each of the selectively releasable fasteners of the rearward strap including a male and a female component spaced from one another along respective looping portions of the rearward strap;

attaching the mounting portion of each forward strap to the inner surface of the dome on respective opposing sides proximate the forward portion of the dome;

attaching the mounting portion of the rearward strap to the inner surface of the dome at the rearward portion of the dome; and extending the looping portions of the forward and rearward straps over the rim and the expanded portion of the dome and looping the looping portions of the straps around the elastic camouflage band and engaging the male and female components of the respective releasable fasteners to form closed loops about the elastic camouflage band with the looping portions.

22. A method as in claim 21 wherein the releasable fasteners are hook and loop fasteners.

23. A method as in claim 21 wherein the helmet further comprises a helmet suspension system disposed inside the cavity of the dome and attached to the inner surface of the dome with a plurality of bolts, and the step of attaching the straps to the dome includes attaching the straps to the inner surface of the dome with the same bolts used to attach the helmet suspension system to the inner surface of the dome.

24. A method as in claim 21 wherein the helmet further comprises a camouflage cover covering the outer surface of the dome and having a plurality of slits therein, the elastic camouflage band being fitted over the camouflage cover, and the step of extending and looping the looping portions of the straps includes extending the looping portions of the straps from the inner surface of the dome, under the camouflage cover, over the rim and out of the camouflage cover through respective slits in the camouflage cover to engage the elastic camouflage band.

* * * * *